US005855374A

United States Patent [19]

Shoemaker, Jr.

[11] Patent Number: 5,855,374

[45] Date of Patent: Jan. 5, 1999

[54] CRANE GAME INCLUDING VACUUM AND ROTARY TABLE

[76] Inventor: Stephen P. Shoemaker, Jr., 140 The Village #401, Redondo Beach, Calif. 90277

[21] Appl. No.: 814,813

[22] Filed: Mar. 10, 1997

[51] Int. Cl.[6] ..... A63F 9/00

[52] U.S. Cl. ..... 273/447; 273/DIG. 25

[58] Field of Search ..... 273/447, 448, 273/DIG. 25

[56] References Cited

U.S. PATENT DOCUMENTS

| | | | |
|---|---|---|---|
| 1,417,663 | 5/1922 | French . | |
| 1,539,546 | 5/1925 | Deenik . | |
| 1,878,894 | 9/1932 | Sallee . | |
| 1,927,877 | 9/1933 | Meyer | 212/42 |
| 1,938,834 | 12/1933 | Graf | 221/146 |
| 2,005,692 | 6/1935 | Margolith | 273/138 |
| 2,057,880 | 10/1936 | Collison et al. | 312/35 |
| 2,143,111 | 1/1939 | Hayes | 214/86 |
| 2,302,821 | 11/1942 | Walton | 312/35 |
| 2,600,849 | 6/1952 | Collins et al. | 212/21 |
| 2,743,024 | 4/1956 | Schmitt et al. | 212/24 |
| 3,572,703 | 3/1971 | Greene | 273/1 |
| 3,764,900 | 10/1973 | Baldwin | 324/71 R |
| 4,133,525 | 1/1979 | Balles et al. | 273/1 E |
| 4,246,452 | 1/1981 | Chandler | 200/5 A |
| 4,272,649 | 6/1981 | Pfeiffer | 179/1 SM |
| 4,369,579 | 1/1983 | Mizoule | 33/1 M |
| 4,408,103 | 10/1983 | Smith, III | 200/6 A |
| 4,550,503 | 11/1985 | Klawitter | 33/18 R |
| 4,600,083 | 7/1986 | Parent et al. | 187/7 |
| 4,685,673 | 8/1987 | Verstraeten | 273/1 GC |
| 4,718,667 | 1/1988 | Shoemaker, Jr. et al. | 273/1 GC |
| 4,778,176 | 10/1988 | Shoemaker, Jr. et al. | 273/1 GC |
| 5,271,628 | 12/1993 | Okada | 273/448 |
| 5,397,134 | 3/1995 | Fishman et al. | 273/448 |
| 5,513,772 | 5/1996 | Glaser | 221/211 |

FOREIGN PATENT DOCUMENTS

| | | | |
|---|---|---|---|
| 685361 | 2/1969 | Italy . | |
| 4084985 | 3/1992 | Japan | 273/447 |
| 455355 | 11/1936 | United Kingdom . | |
| 574507 | 2/1944 | United Kingdom . | |
| 789575 | 4/1955 | United Kingdom . | |
| 2214909 | 9/1989 | United Kingdom | 273/448 |

OTHER PUBLICATIONS

Science Newsfront, Popular Science, Jun. 1984, p. 14.

*Primary Examiner*—William H. Grieb
*Attorney, Agent, or Firm*—Hickman & Martine, LLP

[57] ABSTRACT

An improved vacuum crane game and method. Multiple prizes are provided on a rotating turntable. A player may control horizontal movement of a vacuum pick-up device positioned above the prize area. The pick up device includes a vacuum head that may be raised and lowered relative to the turntable in a z-direction. The vacuum head is used to pick up one of the prizes using a suction force that is provided by a vacuum pump coupled to the vacuum head by a hose and located away from the vacuum head. In one embodiment, a vacuum sensor in the vacuum head may sense whether a prize is picked up. The pick-up device is moved to a dispenser area and the suction force is removed to allow the prize to fall to a conveyor device, which moves the prize to a dispenser where it is delivered to the player.

50 Claims, 9 Drawing Sheets

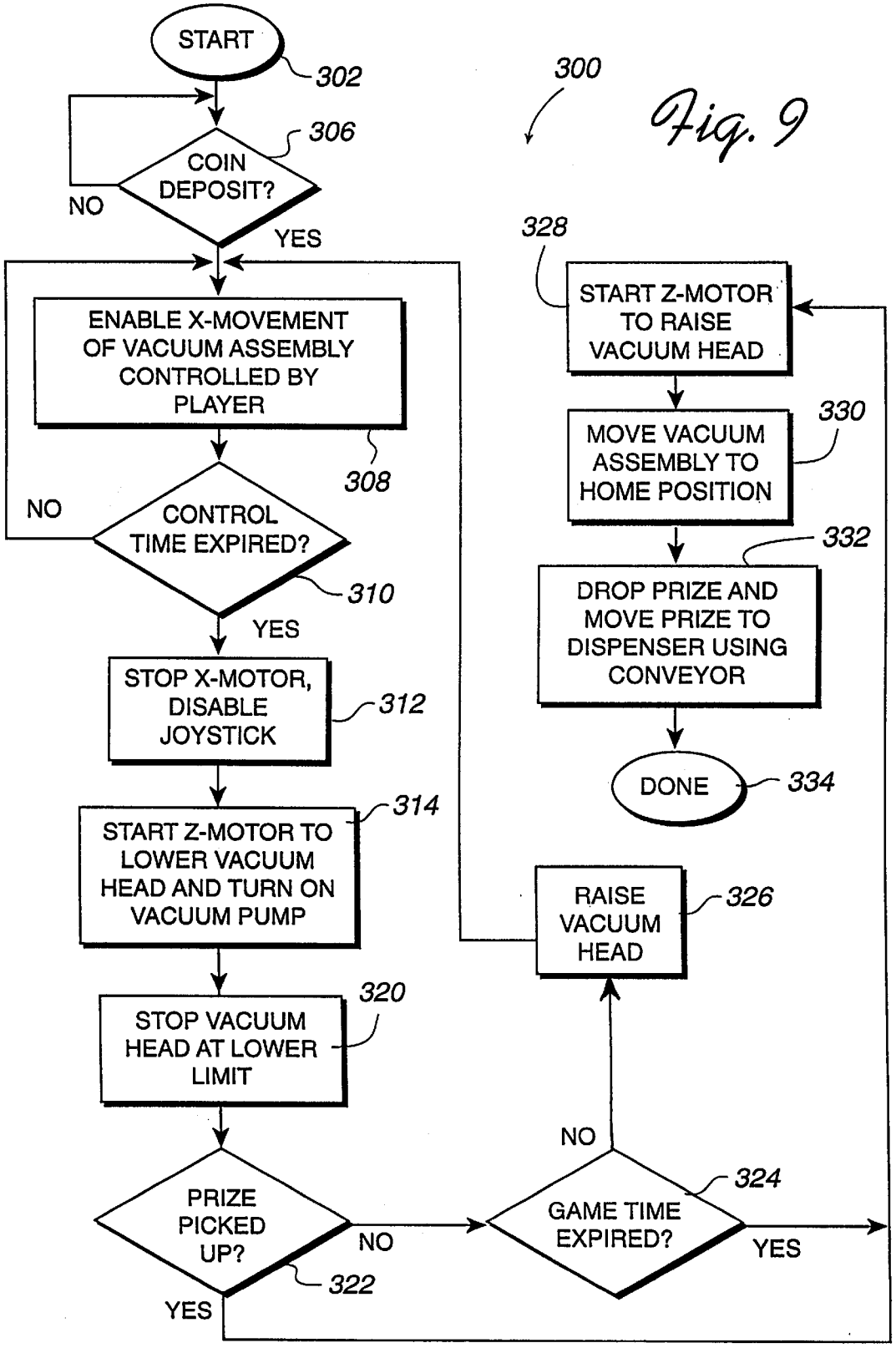
START
302
300
Fig. 9
306
COIN DEPOSIT?
NO
YES
328
START Z-MOTOR TO RAISE VACUUM HEAD
ENABLE X-MOVEMENT OF VACUUM ASSEMBLY CONTROLLED BY PLAYER
330
MOVE VACUUM ASSEMBLY TO HOME POSITION
308
NO
CONTROL TIME EXPIRED?
332
DROP PRIZE AND MOVE PRIZE TO DISPENSER USING CONVEYOR
310
YES
STOP X-MOTOR, DISABLE JOYSTICK
312
DONE
334
314
START Z-MOTOR TO LOWER VACUUM HEAD AND TURN ON VACUUM PUMP
RAISE VACUUM HEAD
326
320
STOP VACUUM HEAD AT LOWER LIMIT
NO
324
PRIZE PICKED UP?
NO
GAME TIME EXPIRED?
YES
322
YES

CRANE GAME INCLUDING VACUUM AND ROTARY TABLE

BACKGROUND OF THE INVENTION

1. Field of the Invention

This invention relates to arcade games, and more particularly to crane-type arcade games in which a player controls a mechanical apparatus to pick up and dispense offered prizes.

2. Background of the Related Art

Crane-type or "claw machine" arcade games are popular amusement devices often provided in game arcades, stores, or other public places. In these types of games, prize objects are provided within a closed housing and are viewable by a player through transparent glass or the like. Upon the insertion of a coin or other monetary input into the game, the player controls a mechanical claw or other grasping implement with controls such as a joystick, buttons, or toggle switch. Typically, the claw is provided above the prize objects and the player can change the position of the claw over the prizes. The claw is lowered towards the prizes upon activation by either a controller such as a computer or the player, depending on the particular embodiment. The claw is either automatically opened when it reaches the level of the prizes or is opened under the player's control. After a predetermined amount of time, the claw is automatically elevated. The claw may or may not be able to grasp a prize and hold onto the prize as the claw is raised. The controller then moves the claw over to a dispensing container and opens the claw, allowing the prize (if any is held) to drop into the dispensing chute and to be guided through the dispenser to an opening accessible to the player. In a common implementation, a sensor within the dispenser detects whether a prize has been won by the player. After the claw is opened over the dispenser, the controller moves the claw to its original starting position and waits for another insertion of the coin (unless the player is provided with multiple tries).

The prizes that the operator of a claw-type crane game can provide in the game are usually limited in selection. Since the claw must surround an object to be able to pick it up, most prizes in claw-type crane games have been limited to large stuffed dolls or other soft, rough-surfaced merchandise that can be surrounded and grabbed by the claw fingers and raised from the supporting surface. Usually, flat, smooth or thin objects are not able to be picked up and held by the claw. However, a large number of flat, smooth, and thin objects are desirable to used as prizes in a crane-type game, such as smooth-surfaced spheres or eggshell containers, boxes, gumballs, cups, bulbs, Christmas ornaments, trading cards, jewelry, etc. Players desire to win these types of items and operators desire to provide them; however, the standard claw type mechanism cannot be used to pick them up.

One solution to the inability of claw-type cranes to pick up these objects is to provide a different type of pick-up device. One type of device that is used is a vacuum device that uses air suction to grab and hold an object. In U.S. Pat. No. 5,513,772 of Glaser, a vacuum embodiment of a crane pick-up game is disclosed in which a vacuum motor is suspended from a string and concealed by a facade or enclosure. The player may move the motor and lower the motor towards a field of prizes similarly to the claw in claw-type crane games. A spinning fan within the motor creates a suction force which is used to pick up and hold prizes. An orifice with a screen is used to prevent items from being sucked into the orifice. Prizes captured and held by the suction are dispensed to the player through a dispenser.

The Glaser vacuum device can pick up some objects which cannot be picked up and held by prior claw-type crane games. However, the Glaser device has many drawbacks. The vacuum motor used by Glaser is a large, bulky device. Since this motor must be concealed to add to the aesthetic appeal of the game, a large cover or enclosure is placed over the motor, which obscures the orifice on the device where prizes are captured by the air suction. This prevents the player from positioning the suction orifice with any great accuracy to pick up a prize, thus, decreasing the skill element of the game.

In addition, the vacuum motor used by Glaser is a high powered, heavy, noisy, and inefficient device. Since the vacuum motor creates large centrifugal forces when it is powered, the motor tends to rotate as it is suspended on the string. To prevent this, a telescoping rod is attached to a side of the device to prevent the spinning. The rod adds further complexity and expense to the unit. Also, the large weight of the motor and enclosure can be difficult to lift and adds to the weight carried and moved by the positioning motors, thus requiring that prizes of smaller weight be provided to decrease the total carried weight. Furthermore, the screen suction orifice of Glaser is inefficient at creating suction, thus requiring the high suction force to grab any objects.

Also, the Glaser device only detects prizes that have been dispensed through the dispensing chute to the player. Thus, the game does not detect whether a prize has been picked up until the crane motor is moved over to the dispenser opening and the suction turned off so that the prize can drop into the opening. If no prize is then detected in the dispenser, the player must control the motor to move back over to the field of prizes to continue the process of picking up a prize, which causes inefficient waste of time and power.

SUMMARY OF INVENTION

The present invention provides an improved vacuum crane game apparatus. The improvements described herein lead to a simpler and more efficient vacuum game for operators and a more enjoyable game experience for players.

More specifically, the game apparatus of the present invention includes a prize area having multiple prizes provided therein. In one embodiment, the prizes are provided on a rotating turntable. A vacuum pick up device is positioned above the prize area and may be moved along a horizontal axis above the prize area. The pick up device includes a vacuum head that may be raised and lowered toward the turntable in a z-direction. The vacuum head is operative to pick up one of the prizes using a suction force that is provided by a vacuum pump coupled to the vacuum head by a hose. The vacuum pump is located away from the vacuum head to allow the vacuum head to move without interference. The player may control the movement of the pick up device to position the vacuum head over the prize area at a desired position, lower the vacuum head, and pick up a prize using the suction force. The pick up device is moved to a dispenser area and the suction force is removed to allow the prize to be dispensed to the player. In another embodiment, the vacuum head may be moved in both x- and y-directions above the prize area.

In one aspect, a conveyor device is positioned below the pick up device and receives a prize that has been picked up by the vacuum head and dropped onto the conveyor. The conveyor includes a moving belt which carries the received prize to a dispenser opening. The vacuum head preferably includes a suction cup at one end for assisting in the picking up of the prizes, where the suction cup is made of a flexible material for easily conforming to the shape of a prize. The vacuum head is suspended from a carriage by a flexible member such as a cord or string which is coupled to a roller driven by a motor. A limit switch detects a predetermined limit of movement of the vacuum head along the z-axis.

In another aspect, the vacuum head further includes a vacuum sensor that detects air flow through the hose to detect when a prize has been picked up by the vacuum head. A digital controller of the game apparatus monitors the vacuum sensor to determine when a prize has been picked up by the vacuum suction device. The digital controller also commands motors for driving the pick up device along the z-axis and x-axis.

A method of the present invention provides a vacuum crane game providing multiple prizes and creates a suction force from a vacuum head using an air flow. The player may influence movement of the vacuum head toward the prizes, which may be rotated on a turntable, and one of the prizes is picked up with the vacuum head using the suction force. In some embodiments, the prize can be sensed when it has been picked up by the vacuum head, such as by a vacuum sensor that senses air flow. The vacuum head is moved to a dispensing area and the suction force is deactivated to allow the prize to drop into the dispensing area, where said prize is dispensed to the player. The dispensing area may include a conveyor device that moves the dropped prize to a dispenser opening. In one embodiment, if a prize has not been picked up, the player may control movement of the vacuum head until a prize is picked up.

The improved vacuum crane game of the present invention provides an efficient and easy-to-use mechanism for picking up prize objects. The vacuum head moved by the player is lightweight and includes no motor or other mechanism, thus allowing a player to position it very accurately. The rotating turntable and conveyor device allow the movement mechanism of the game to be simple and less expensive than other designs. The vacuum sensor allows the game to detect when a prize has been picked up and thus provides more flexibility in determining player options in the game, as well as providing more efficiency for movement of the pick up device.

These and other advantages of the present invention will become apparent to those skilled in the art after reading the following descriptions and studying the various figures of the drawings.

BRIEF DESCRIPTION OF THE DRAWINGS

FIG. 9 is a flow diagram illustrating a method of operating the game apparatus of the present invention.

DETAILED DESCRIPTION OF THE PREFERRED EMBODIMENTS

Figure 1:
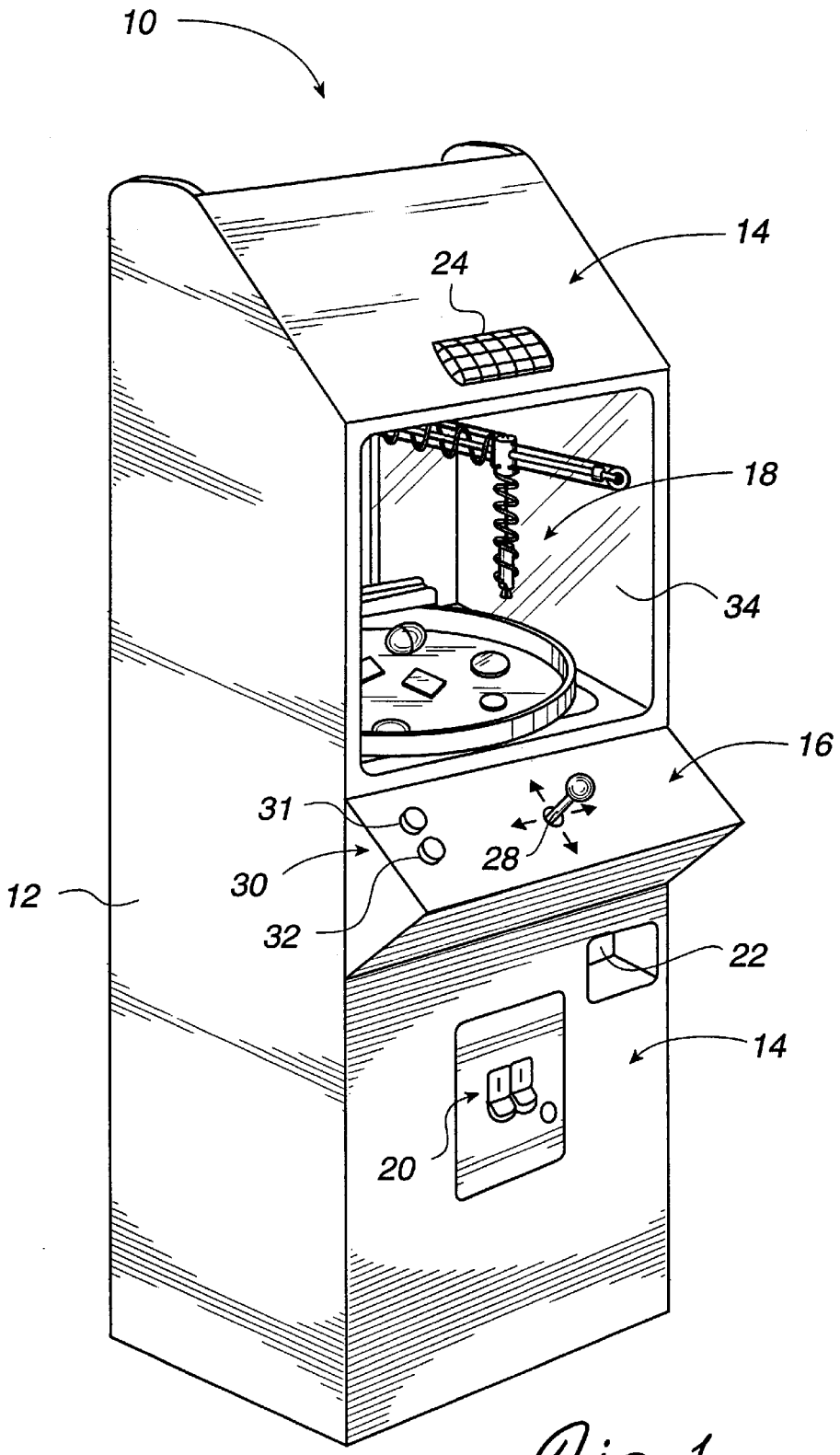
FIG. 1 is a perspective view of a vacuum crane game apparatus of the present invention.

FIG. 1 is a perspective view of one embodiment of a game apparatus 10 in accordance with the present invention. Game apparatus 10 includes a housing 12, front panel 14, player controls 16, and a playing area 18.

Housing 12 provides a support for the other components of the game apparatus. Housings can take a wide variety of forms; for example, as shown in FIG. 1, housing 12 may be of the stand-up arcade game variety in which a player stands in front of the game or sits on a stool when playing the game. In other embodiments, other types of housings may be provided. For example, a counter-top housing, including approximately the upper half of housing 12 shown in FIG. 1, can be used when the game apparatus is desired to be placed on a table, counter top or other similar surface.

Front panel 14 can be positioned below and/or above the player controls 30 and playing field 18, as shown in FIG. 1. The front panel can also be positioned in a wide variety of other locations on housing 12. Front panel 14 includes a coin deposit slot 20, dispenser 22, and speaker 24.

Coin deposit slot 20 typically accepts standard currency coins, game tokens, or bills that are often available in an arcade environment. In some embodiments, other types of monetary input may also be provided, such as a credit card, debit card, etc. A coin deposited in coin deposit slot 20 starts a game. Dispenser 22 is used to provide prizes to the player which have been won by the player from playing the game. Dispenser 22 guides a prize from playing area 18 to a player-accessible door and/or aperture from which the player retrieves the prize. Speaker(s) 24 emits sounds based on game actions and other game states and is controlled by a game control system as described subsequently. The front panel 14 can also include other features if appropriate. For example, in an alternative embodiment, a ticket dispenser (not shown) may be included on front panel 14 if desired to dispense a ticket award to the player based upon a game score, characteristics of a captured object, or other result or event of a game, rather than (or in addition to) providing the player with a prize in dispenser 22.

Player controls 16 allow a player to manipulate events in the game, and typically include a joystick, buttons, switch, knob, or the like. Game action occurs in playing area 18, where a pick up mechanism may be controlled and guided by the player to pick up prize objects, as described below. In the described embodiment, a joystick 28 or similar device (knob, two buttons, etc.) can be manipulated by the player to move the pick up device in two directions along an axis (or additional directions, in alternate embodiments). Buttons can also be provided to select various game functions, such as additional directional control of the pick up device, number of players in a game, a start button to begin the game, etc. For example, in the described embodiment, a slow button 31 can be pressed by the player to slow down (or stop) the rotational movement of a prize turntable so as to allow the player to more accurately position the pick up device. In alternate embodiments, the player may be able to control motion of other components of the game, such as horizontal or downward movement of the pick up device. In some embodiments, a player may get multiple chances to guide the pick up mechanism with one coin or credit, or, alternatively, the player may be required to insert additional coins.

Game playing area 18 is used to display the game action and prizes to a player and is the area where game action occurs. A transparent shield 34 can prevent the player from interfering with game action. The playing area 18 houses a prize display area 36, a vacuum pick up device 38, a conveyor device 40, and a dispenser opening 42. The player guides the head of the pick up device 38 and lowers the head so that a prize may be picked up. If a prize is picked up, the game controller automatically guides the pick up head above the conveyor device 40, drops the prize onto the conveyor, and moves back into a starting position. The conveyor moves the prize to dispenser opening 42, which routes the prize to the player via dispenser 22. This game operation is described in greater detail below.

The player controls 16, pick up device 38, and other functions of the game apparatus 26 are preferably controlled by a control system. This system is described in detail with respect to FIG. 8.

Figure 2:
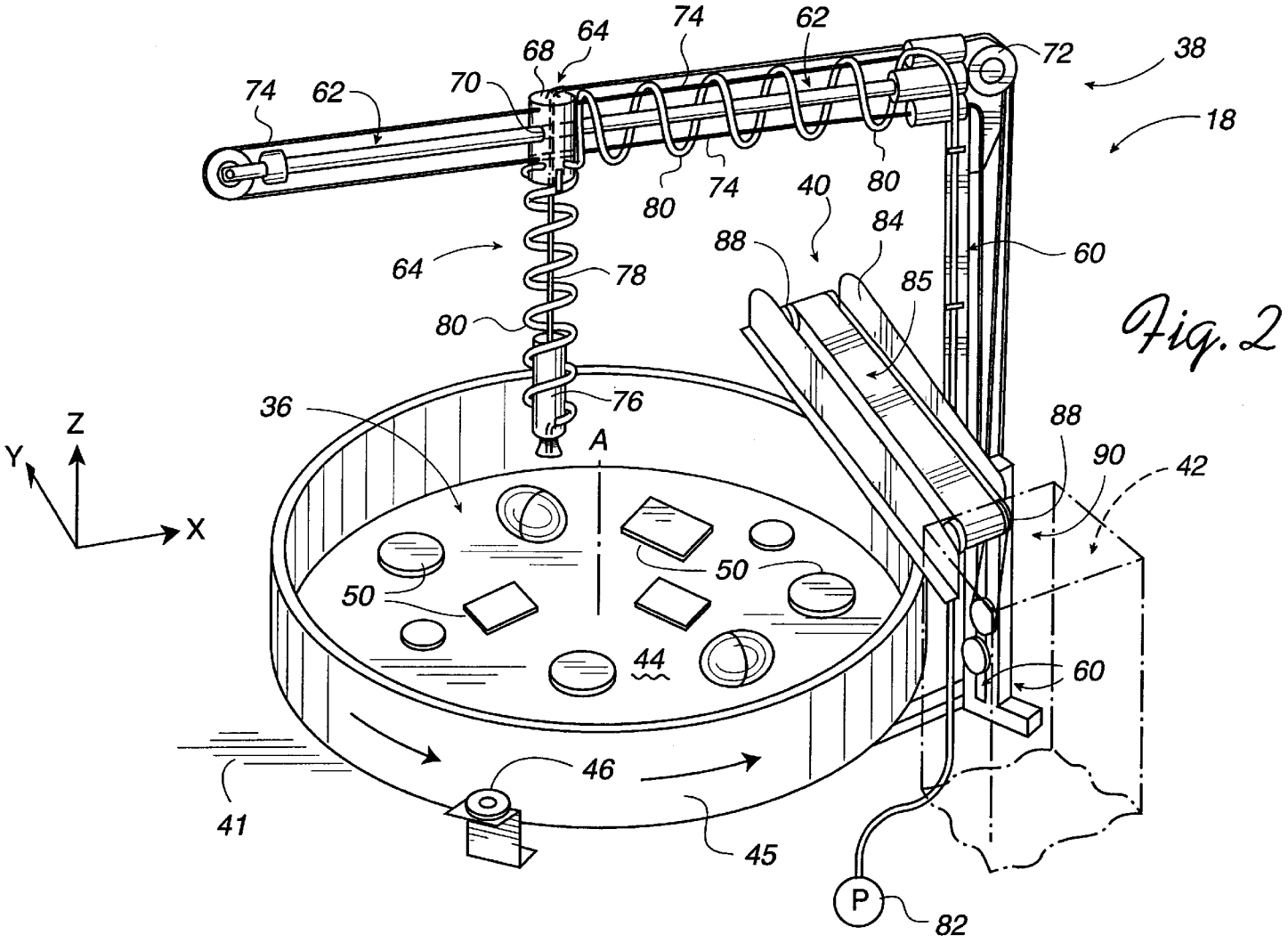
FIG. 2 is a perspective view of a pick up device and playing area of the game apparatus of FIG. 1.

FIG. 2 is a perspective view of playing area 18 of the game apparatus 10 of the present invention. Playing area 18 includes a floor 41, prize display area 36, a vacuum pick up device 38, conveyor device 40, and dispenser opening 42. Floor 41 is an approximately horizontally-aligned surface coupled to housing 12 of the game apparatus. As shown, the floor 41 is rectangular, but may also be a variety of shapes. In alternative embodiments, the floor and/or prize display area may be aligned at other angles.

Prize display area 36 includes a rotary table 44 and a sidewall 45. Table 44 is rotated about an axis A in a clockwise or counterclockwise direction by spaced roller wheels 46 on which the table rests. One of the wheels is driven by a motor, as detailed with respect to FIG. 3. The rotation of the table 44 is controlled by the game system controller, which is described in greater detail with respect to FIG. 8. Sidewall 45 is preferably arranged around the perimeter of table 44 so as to keep prizes from falling off the table during rotation or when the prizes are moved by the player's control of pick up device 38. In alternate embodiments, fixed structures, obstacles or objects can be provided on rotary table 44 to separate the prizes. The player can be required in some embodiments to guide the pick up device 38 around the structures to pick up a prize object. In one embodiment, the player may slow or stop the rotation of turntable 44 using a player button or other control during a game. Such functionality is described in detail subsequently.

Prizes 50 are distributed over the surface of table 44. These prizes may include any object having a surface suitable to which to apply suction force. For example, objects such as trading cards, plastic mirrors, coins, jewelry (rings, wristwatches, etc.), cardboard milk bottlecaps or "pogs", eggshell containers in which a small toy is stored, small boxes, etc., can be used. Since pick up device 38 uses vacuum suction to collect prizes, small and smooth objects (e.g., objects having at least one smooth surface) may be used as prizes rather than the larger, pliant objects that must be used as prizes in standard claw device pick up games. In addition, if a larger vacuum pump or other device is used to gain high suction force with pick up device 38, then larger objects may be used as prizes.

Vacuum pick up device 38 is used to retrieve a prize 50 and move the prize to the dispenser 22 so that the player may access and remove the prize. Pick up device 38 includes a vertical support 60, a horizontal guide rod 62, and a moveable vacuum assembly 64. Vertical support 60 extends up from floor surface 40 approximately perpendicular to the surface of rotary table 44. Horizontal guide rod 62 is coupled to the vertical support 60 and extends over the rotary table 44. Preferably, the guide rod 62 extends approximately through the center of the table 44 such that axis A intersects the guide rod. Alternatively, the guide rod can be positioned at different angles relative to the playing area; for example, the rod 62 can extend across diagonal corners of the playing field or from a side of the playing field.

Vacuum assembly 64 is operative to move along the guide rod 62. A carriage 68 includes a bore 70 through which guide rod 62 extends. A motor-driven pulley system for moving the carriage includes a line 74 which is coupled to carriage 68 which causes the carriage 68 and the vacuum assembly 64 to move along rod 62 parallel to an x-axis when the line 74 is moved by the pulley system. This operation is described in greater detail with respect to FIGS. 3 and 5. The rotational movement of rotary table 44 combined with the linear movement of vacuum assembly 64 allows the vacuum assembly to be positioned above any point on the surface of the rotary table. This allows the player to position the vacuum head to retrieve any prize 50 located on the rotary table. Therefore, when a rotary table 44 is used, the vacuum head assembly 64 need only be moved in one horizontal axis, e.g., only x-axis movement need be provided instead of both x-axis and y-axis movement, thus simplifying the design of the game and leading to reduced cost to manufacture and maintain the game. In alternate embodiments, an x-y axis movement apparatus can be used to move the vacuum assembly above any point on the prize surface, and the prizes 50 can be placed on a non-moveable surface. Such an x-y movement mechanism is described below with respect to FIG. 10.

Vacuum assembly 64 also includes a vacuum head 76 suspended by a line 78 from carriage 68. Line 78 is routed through the carriage 68 to a pulley system (not shown) which is driven by a motor to wind the line onto a roller, causing vacuum head 76 to be raised vertically from rotary table 44. Similarly, the motor may unwind the line from the roller, causing vacuum head 76 to lower vertically towards rotary table 44. The pulley system for vertical (z-axis) movement of vacuum head 76 is described in greater detail with respect to FIG. 3.

A vacuum hose 80 is also coupled to vacuum head 76 and is coiled around head 76, around line 78, through a bore in carriage 68, around guide rod 62, and down vertical support 60 to a vacuum pump 82 (shown schematically). Pump 82 is preferably physically coupled to the housing 12 of the game apparatus or to the vertical support 60 (the pump may also be coupled to carriage 68). Pump 82 provides a suction force or vacuum pressure at the end of the vacuum hose near the end of vacuum head 76 by sucking air though the hose, as is well known to those skilled in the art. Pump 82 can be any suitable air pumping device; for example, a suitable pump is Oilless Diaphragm Pump, model 15D1- P101-KGB by Gast. Other vacuum, pump, or air flow devices can also be used. Pump 82 is advantageous over the prior art for use in crane games in that a complex, heavy, noisy, expensive motor need not be used: pump 82 can be an inexpensive, quiet, simple device. In addition, a large amount of suction can be provided with pump 82 using a small amount of air flow compared to the prior art vacuum games. Pump 82 is also located away from the vacuum head 76 and thus does not interfere with motion of the vacuum head. No stabilizer is therefore required to prevent the vacuum head from spinning or moving due to movement of the pump.

Conveyor device 40 is coupled to vertical support 60 or to floor 41 and may be used to direct a prize toward dispenser opening 42. The conveyor device is useful in the described embodiment to carry a prize to a dispenser area that is located in a peripheral area of the playing area 18. For example, in one preferred embodiment, the vacuum assembly 38 may be moved along an x-axis aligned so that the assembly moves toward and away from the player, a configuration often preferred by players. To allow the prize objects 50 to be positioned as close to the player as possible on rotary table 44, the dispenser opening 42 is positioned in a corner of the playing area. Conveyor 40 is used to carry a prize to the dispenser opening without requiring a separate y-axis movement mechanism for vacuum assembly 38.

In the described embodiment, conveyor device 40 includes a support platform 84, a moving belt 85, a drive belt 86, and pulleys 88. Moving belt 85 is wrapped around pulleys 88 supported by platform 84, and drive belt 86 is routed around one of pulleys 88. Drive belt 86 is driven by the motor-driven pulley system, which in turn moves belt 85. When a prize is dropped onto the belt 85 from vacuum head 76, the prize is carried toward end 90 of platform 84, where the prize drops off the end into the dispenser opening 42 (shown in dashed lines). The delivery chute directs the prize toward dispenser 22 on front panel 14 of the game apparatus 10, where the player retrieves the prize. The operation of the conveyor device is described in greater detail with respect to FIGS. 4*a* and 4*b* . In alternative embodiments, the vacuum head can be moved directly over dispenser opening 42 and can drop a picked up prize directly into the opening.

Figure 3:
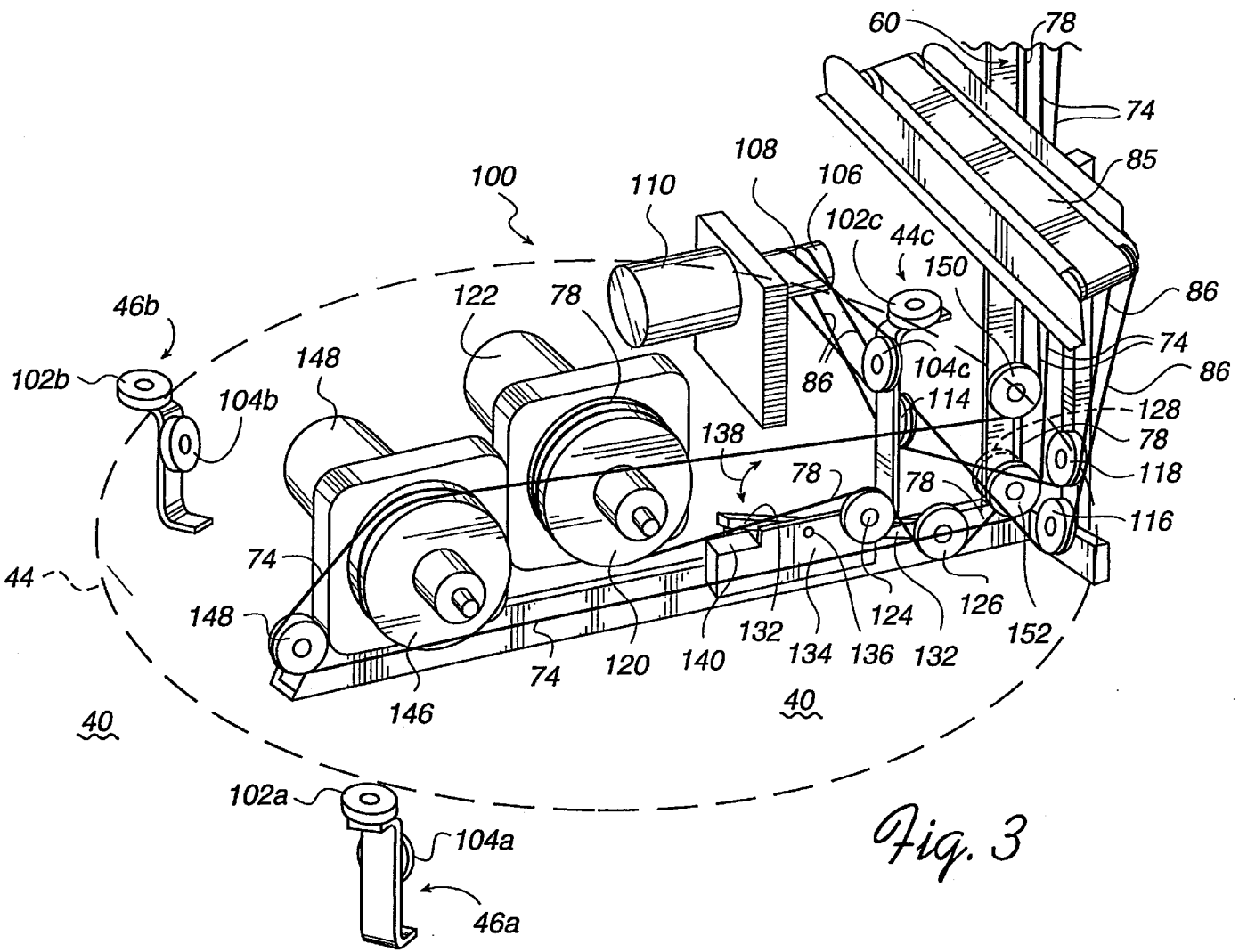
FIG. 3 is a perspective view of a drive system suitable for use with the present invention.

FIG. 3 is a perspective view of a drive system 100 suitable for use with the game apparatus 10 and playing area 18. Drive system includes motors or other types of actuators for driving the rotation of rotary table 44, the movement of the belt of conveyor device 40, and the movement of vacuum assembly 68. The motors are controlled by a control system as described with reference to FIG. 8.

Roller wheel assemblies 46*a* , 46*b* , and 46*c* are provided to allow rotary table 44 (shown in dashed lines) to rotate about axis A. Each wheel assembly 46 includes a horizontal wheel 102 for preventing the turntable 44 from moving laterally out of position, and a vertical wheel 104 to permit the table 44 to rotate in place. Vertical wheel 104*c* is coupled to a pulley 106 by a belt 108, and pulley 106 is driven by motor 110. Motor 110 thus operates to rotate pulley 104*c* , which in turn rotates the table 44 about axis A. In one embodiment, motor 110 can be slowed or stopped by player controls 16, as described below.

Motor 110 is also operative to drive the conveyor device 40. Drive belt 86, as shown on conveyor device 40 in FIG. 2, is coupled to pulley 106 to one side of where belt 108 is coupled to pulley 106. Belt 86 is routed around a pulley 114, and then one end of the belt 86 is routed to pulley 116 while the other end of the belt 86 is routed to pulley 118. The two ends of the belt 86 are then joined at conveyor device 40, as described with reference to FIGS. 4*a* and 4*b* . Motor 110 thus rotates pulley 106, which moves belt 86 and causes prize objects to move to dispenser opening 42 when the prize objects are placed on belt 85 of conveyor device 40. In alternate embodiments, a separate motor or other actuator can be used to drive conveyor 40 independently of rotary table 44.

Figure 5:
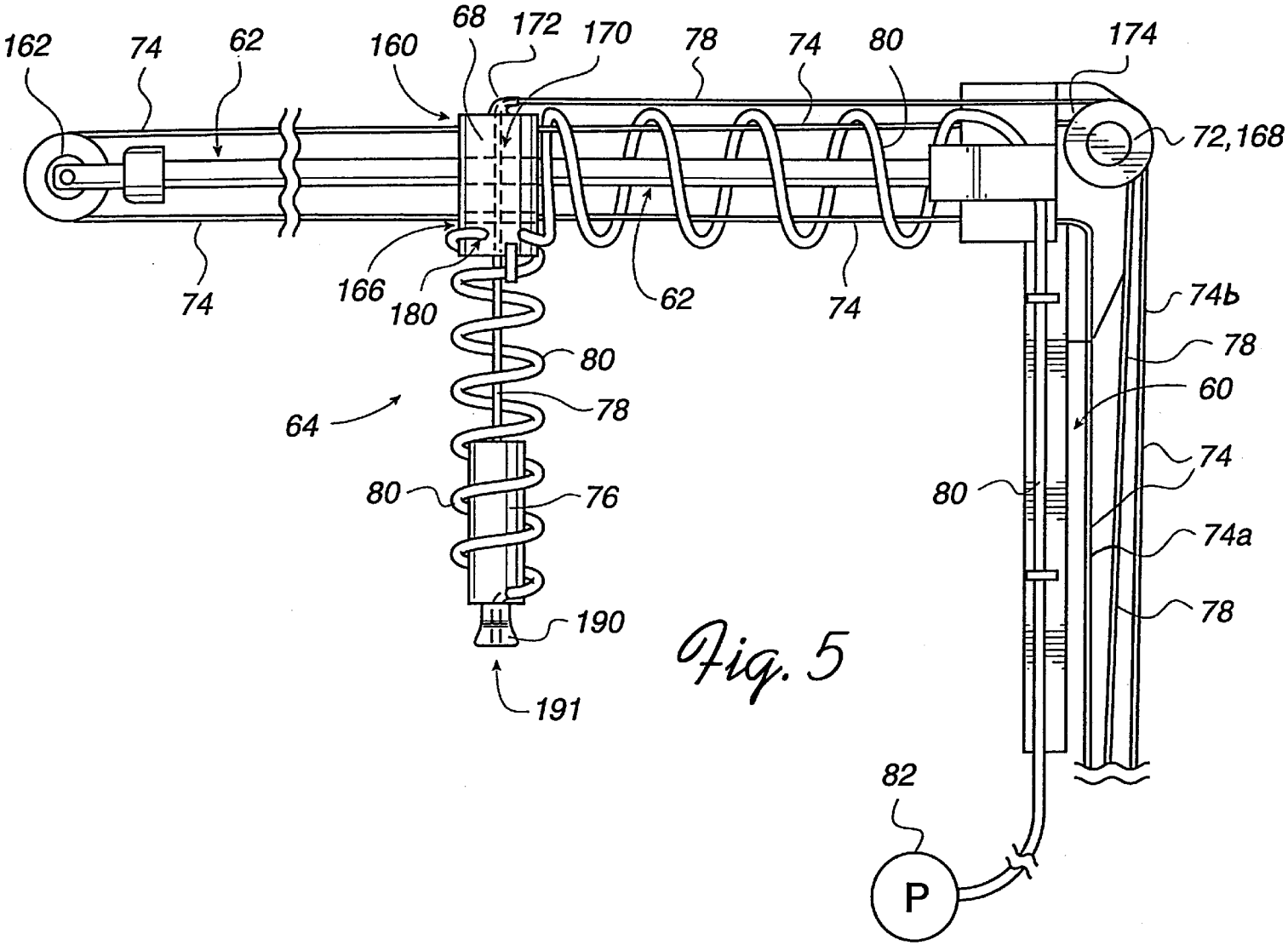
FIG. 5 is a side elevational view of the vacuum pick up device of the present invention.

Roller 120 is rotatably coupled to floor surface 40 and is driven by a motor 122. Line 78 is attached to roller 120 and is wound around the roller a number of times. The line 78 extends from roller 120 to pulley 124, and then to pulley 126. From pulley 126, line 78 is wrapped around pulley 128 and then extends vertically up vertical support 60 to pulley 72 as shown in FIG. 2. From pulley 72, line 78 extends through carriage 68 to vacuum head 76 and suspends the head 76 from the carriage 68, as shown in FIGS. 2 and 5. Motor 122 is thus operative to wind or unwind line 78 from roller 120 to raise or lower vacuum head 76.

Pulley 126 guides line 78 and is also coupled to a pivoting member 132. Member 132 is pivotally coupled to support 134 at a joint 136 and may pivot as shown by arrow 138. A limit switch 140 is provided at one end of pivoting member 132. While the vacuum head 76 is suspended from carriage 68, it pulls line 78 taut, which causes member 132 to contact limit switch 140. However, when vacuum head 76 reaches the surface of rotary table 44 (or a prize or obstruction on table 44), line 78 no longer is taut, which causes pivoting member 132 to rotate and disengage from limit switch 140, causing the switch to open. This causes motor 122 to deactivate. Thus, switch 140 detects when the vacuum head 76 reaches the lower limit to z-movement and prevents the roller 120 from unwinding line 78 past this limit.

Roller 146 is rotatably coupled to floor surface 40 and is driven by motor 148. Line 74 is wrapped around roller 146 and pulley 148 as shown, such that a first end of line 74 extends toward and is wrapped around pulley 150 and is routed up vertical support 60, along the underside of guide rod 62, through a bore in carriage 68, around pulley 72 at the end of the guide rod, and is coupled at one end to carriage 68. The second end of line 74 extends from pulley 148, is wrapped around pulley 152, and is routed up vertical support 60, along the upper side of guide rod 62, and is coupled at its end to carriage 68. This arrangement is described in greater detail with respect to FIG. 5. Thus, motor 148 is operative to move vacuum assembly 64 in an x-direction along guide rod 62.

Figure 4B:
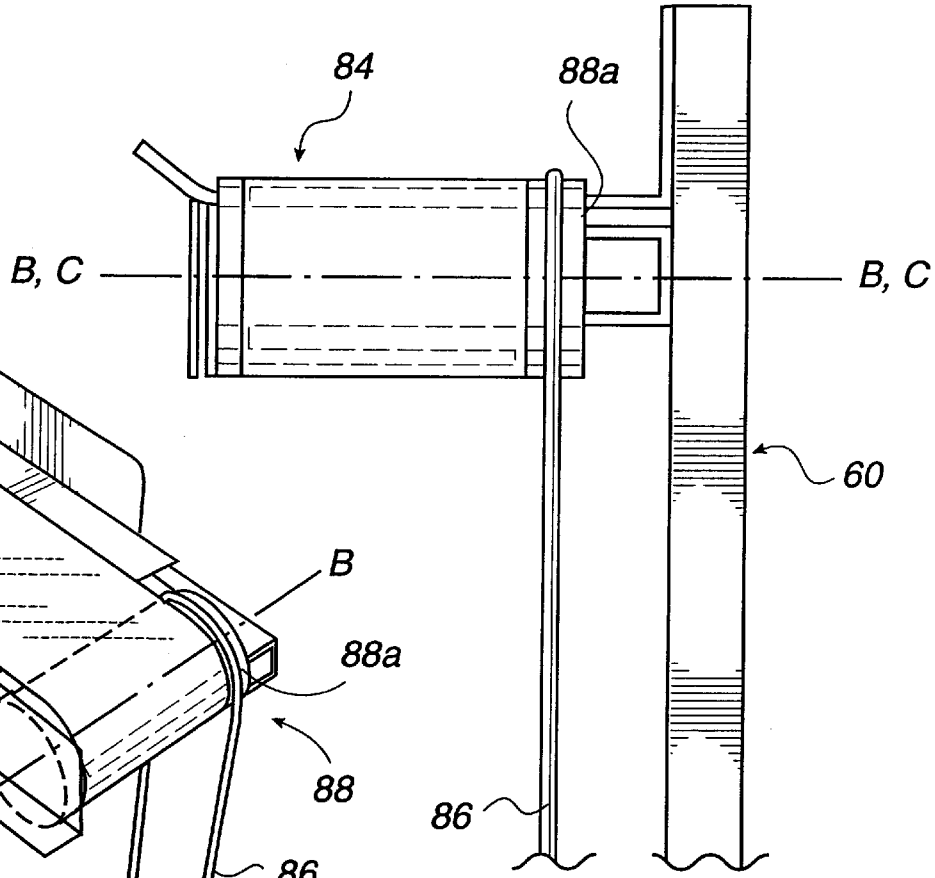
FIGS. 4*a* and 4*b* are detail views of a conveyor device suitable for use with the game apparatus of the present invention.
Figure 4A:
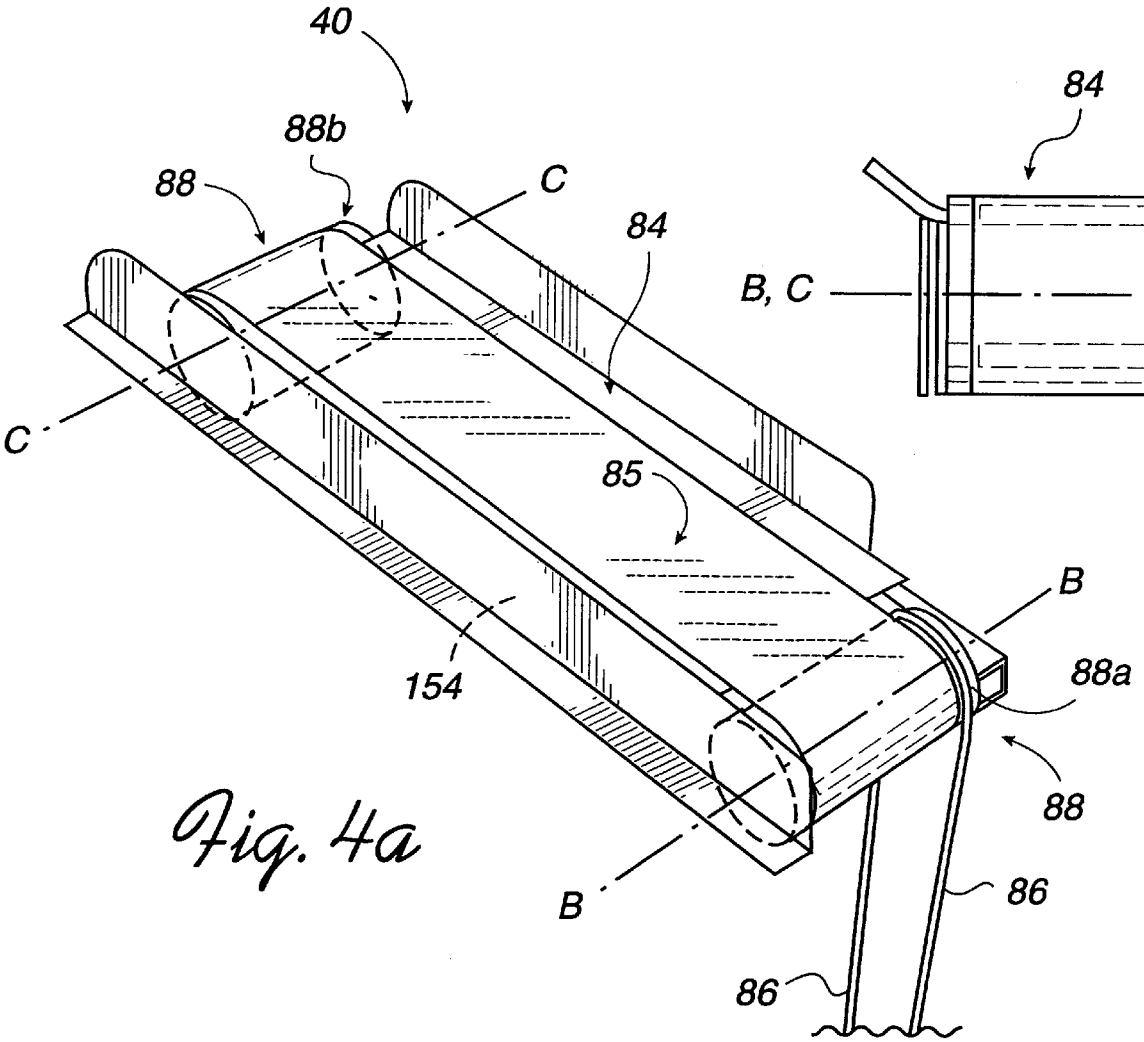

FIGS. 4*a* and 4*b* are detailed perspective and side elevation views, respectively, of conveyor device 40. Conveyor 40 includes support platform 84, belt 86, and pulleys 88. Pulleys 88 include a pulley 88*a* which rotates about an axis B, and pulley 88*b* which rotates about an axis C. A flat moving belt 85 is fully wrapped around the pulleys 88 and moves as a standard conveyor belt when the pulleys 88 are rotated. Drive belt 86 is coupled to pulley 88*a* and is operative to rotate the pulley 88*a* when the belt 86 is moved by motor 110.

Conveyor device 40 operates by moving flat belt 85 in a continuous loop. As shown in FIG. 3, motor 110 drives the drive belt 86 to move such that pulley 88*a* is moved by the belt 86. This, in turn, causes flat belt 85 to move around the pulleys 88 in a direction toward dispenser opening 42. Thus, when a prize object 50 is dropped onto the flat belt 85 on the top side of platform 84 by vacuum assembly 64, the prize object is carried by the moving belt 85 to fall off the end of the platform near the dispenser opening, such that the prize object falls into the dispenser opening and is provided to the player.

Alternatively, the conveyor device can be implemented in many other ways. For example, one embodiment can use drive belt 86 to move around platform 84 and move prizes toward opening 42 such that flat belt 85 can be eliminated. In such an embodiment, a number of pulleys may be provided at one end of platform 84 and rotate about axis B, and a corresponding number of pulleys may be provided at the other end of platform 84 and rotate about axis C. Belt 86 may be routed from a pulley of axis B to a pulley of axis C, back to a second pulley of axis B to a second pulley of axis C, and so on, such that belt 86 is wrapped around platform 84. Belt 86 would then be moved in a continuous loop such that the portions of the belt 86 on the top side of platform 84 are moving toward dispenser opening 42. Many other configurations of conveyor devices can be used in other embodiments.

FIG. 5 is a side elevation view of vacuum pick up device 38, including horizontal guide rod 62 and vacuum assembly 64. Guide rod 62 extends over the turntable 44 and is supported by vertical support 60. Vacuum assembly 64 moves along guide rod 62 using carriage 68, which is translated using line 74. One end 160 of line 74 is coupled to one side of carriage 68, and line 74 extends over the top side of guide rod 62 and around an end pulley 162. End pulley 162 is rotatably coupled to the end of guide rod 62. Line 74 then extends back down below the bottom side of guide rod 62, and is routed through a bore 166 in carriage 68. Line 74 then continues to vertical support 60, where it is routed down towards pulley 150 as shown in FIG. 3.

After being routed around roller 146 and other components as shown in FIG. 3, the line 74 is routed back up vertical support 60, shown as 74*b* in FIG. 5. Line 74 is routed around pulley 72 which is rotatably coupled to vertical support 60. Line 74 then is routed above guide rod 62 and is coupled at its end 170 to carriage 68. Thus, when line 74 is moved by the motor 148 (see FIG. 3), the carriage 68 is moved along guide rod 62, thus moving the vacuum head 76 along the x-axis to different positions over turntable 44.

Vacuum head 76 is suspended from carriage 68 by line 78 and may be lowered or raised along a z-axis. Line 78 is coupled to vacuum head 76, is routed through carriage 68, and is guided through guide 172. Line 78 then extends to vertical support 60, where it is wrapped around a pulley 172 (hidden by pulley 72 in FIG. 5). From pulley 172, line 78 extends down vertical support 60 to pulley 128, shown in FIG. 3. Roller 120 winds up line 78 as controlled by motor 122 to lower or elevate the vacuum head 76. When the vacuum head is lowered to the lowest elevation, limit switch 140 activates, and the motor stops unwinding line 78.

In addition, the vacuum head 76 may be desired to be kept at a constant elevation when carriage 68 is moved along guide rod 62. To achieve this, the z-axis line 78 should be wound and unwound from roller 120 in conjunction with any horizontal movement. This procedure also prevents any sway in vacuum head 76 during horizontal travel. For example, when vacuum head 76 is moved toward pulley 162, line 78 should be unwound at a corresponding rate to the travel of carriage 68 to maintain vacuum head 76 at a constant elevation. Similarly, line 78 should be wound when carriage 68 is moved toward pulley 72. When vacuum head 76 is at a fully raised position, the line 78 is preferably not actively unwound from the roller 120; rather, the line 78 is simply dragged and unwound by the motion of the carriage 68 (this is preferably implemented by making the clutch for motor 148 stronger than the clutch for motor 122).

Vacuum hose 80 is coupled to the opening 191 of vacuum head 76 at one end and is coiled around head 76, around line 78, through a bore 180 in carriage 68, around guide rod 62, and down vertical support 60 to a pump 82 (shown schematically). Hose 80 is coiled around guide rod 62 with enough slack to allow the carriage 68 to move to the end of guide rod 62 near pulley 162 and to allow vacuum head 76 to be lowered until the suction cup contacts a prize or table 44.

Figure 6:
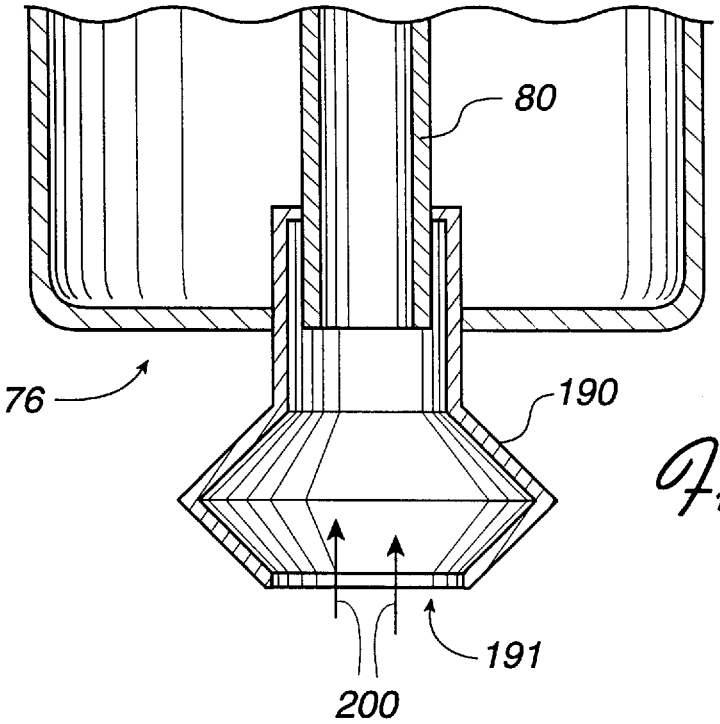
FIG. 6 is a cross sectional view of the vacuum head of the pick up device of FIG. 5.

FIG. 6 is a detailed sectional view of vacuum head 76. Vacuum hose 80 extends through the end portion of vacuum head 76 and is coupled to a suction cup 190. Suction cup 190 is preferably made of a flexible, resilient material such as rubber and has an opening 191. When vacuum head 76 is positioned onto a prize object 50, the prize object is held against the suction cup due to the suction force and the suction cup 190 at opening 191 conforms to the shape of the surface of the prize object, thus allowing a stronger grip when air is drawn into the opening 191 by pump 82.

Figure 7:
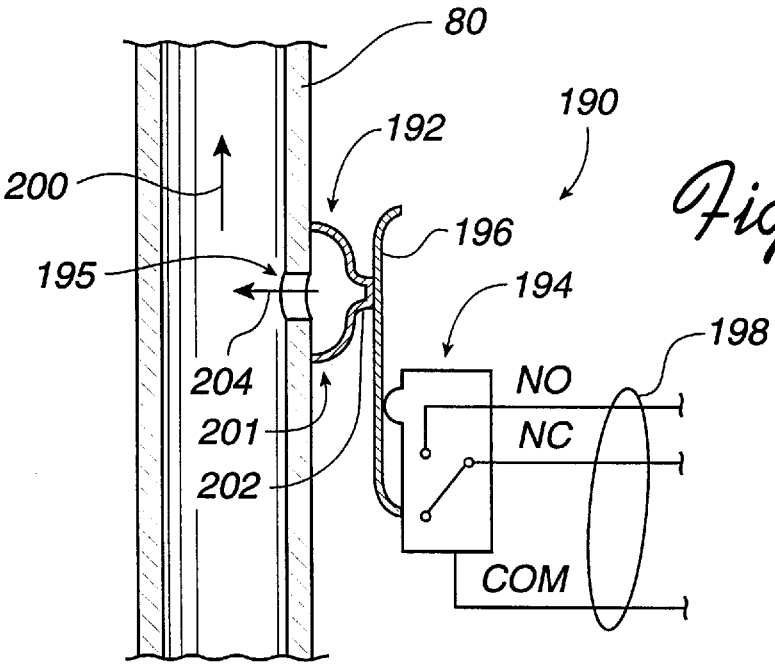
FIG. 7 is a detail view of a vacuum sensor of the present invention.

FIG. 7 is a detail view of a vacuum sensor of the present invention. The game apparatus 10 in some embodiments may include a vacuum switch or sensor 189 which is used to detect when a prize has been picked up. Vacuum sensor 189 may be provided at any point on the vacuum hose 80. For example, the switch is preferably located near pump 82, or may alternatively be provided on vertical support 60, on carriage 68, or in vacuum head 76.

In the described embodiment, vacuum sensor 189 includes a cup 192 and a electrical switch 194. Cup 192 is coupled to hose 80 at one end 201 and is made of a flexible material. Cup 192 can also be coupled to a block or other member which is provided between cup 192 and hose 80 and which includes an aperture to let air flow. Cup 192 responds to the state of air flow in vacuum hose 80 as sensed through an aperture 195 in the hose 80. Cup 192 is also coupled to a contact 196 of the switch 194 at an end 202. Contact 196 may pivot or bend and causes switch 194 to be change to an on or off state. The state of the switch is known by the control system of the game apparatus 10 from control lines 198 (e.g., normally open (NO), normally closed (NC) and common (COM)), which are coupled to a controller or other component of the control system to monitor the state of the switch.

Vacuum switch 189 operates in response to air flow in the vacuum hose. When pump 82 causes air to flow in the direction of arrows 200, cup 192 expands and maintains the position/shape shown in FIG. 6. This causes contact 196 to move and causes switch 194 to be in one state (e.g., a closed state). When a prize object is drawn to the opening 191 of suction cup 190 by the suction force, the prize object is held there by the suction force and blocks further air from flowing through vacuum hose 80. The resulting drawn vacuum in hose 80 causes cup 192 to contract, such that end 202 of the cup moves in the direction of arrow 204, which causes contact 196 to change the state of the switch (e.g., put the switch in an open state). This change of switch state can be detected by the controller of the game apparatus 10, such that when the change in occurs during game play, the controller knows that a prize object has been collected by the player. The controller can then control the vacuum head to deposit the prize to the player, as described below. In an alternative embodiment, the controller can check the state of the vacuum sensor one or more times, or can continually monitor the sensor state, after the prize is picked up. This allows the controller to detect if a collected prize drops from the vacuum head for some reason before or during travel of the vacuum head. For example, once the vacuum head reaches the prize-dropping position, a single check of the vacuum sensor can be made as to whether a prize is still held; if not (in some embodiments), the player may be allowed to continue playing the game.

The vacuum sensor 189 shown in FIG. 7 is merely one example of many possible switches or sensors that can be used in the present invention. Virtually any switching device or sensor capable of sensing air flow is suitable for use in detecting when a prize has been collected by the vacuum head.

Figure 8:
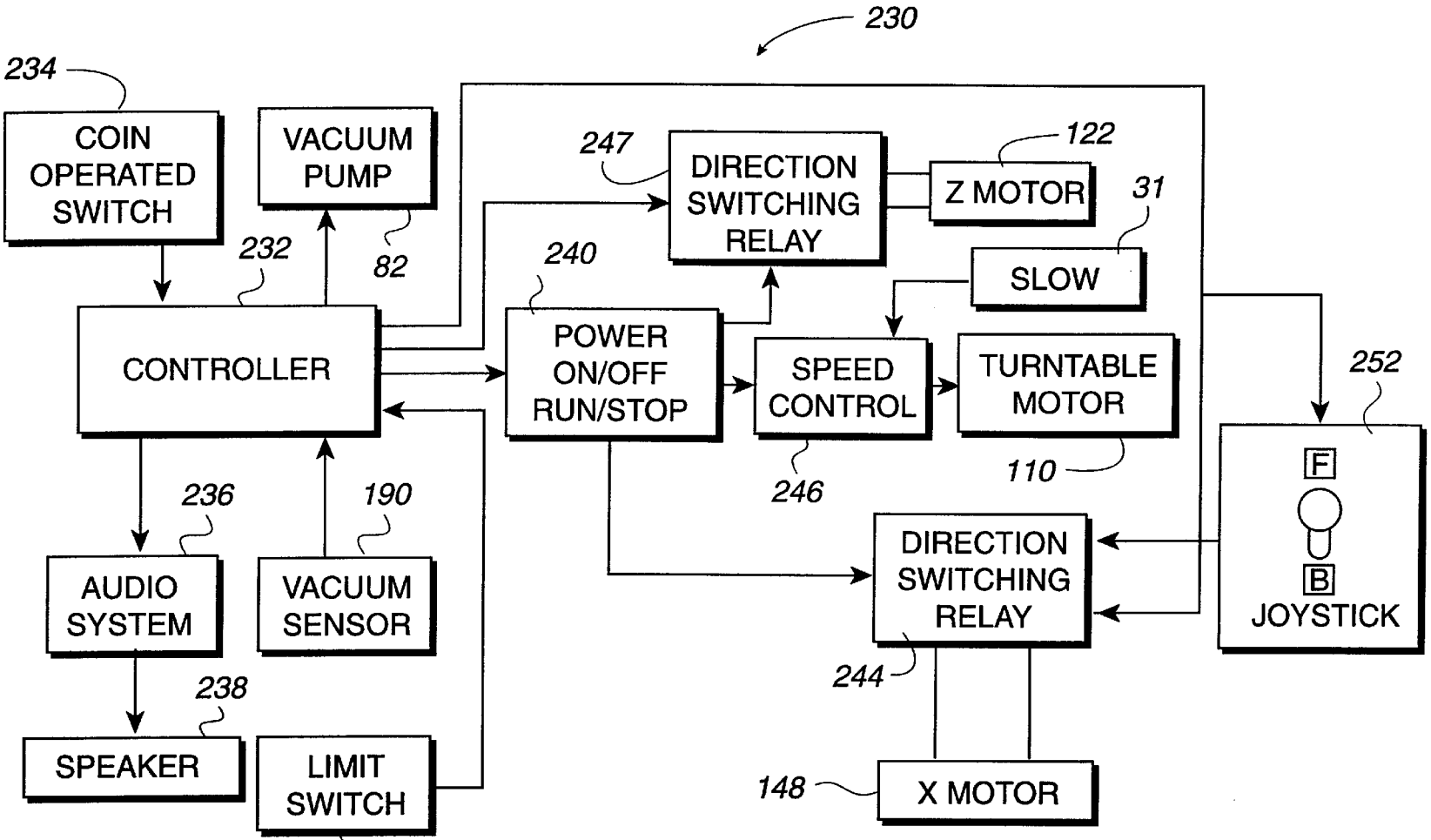
FIG. 8 is a block diagram of a control system for the game apparatus of FIG. 1.

FIG. 8 is a block diagram of a control system 230 suitable to control the operation of game apparatus 10. The control system, for example, can be implemented on one or more printed circuit boards which can be located in the interior of game apparatus 10 and can be connected to such components as motors, solenoids, etc. by electrical wires. Many of the components described in control system 230 are similar to the control system described in U.S. Pat. No. 4,778,176, which is incorporated by reference herein. The components of control system 230 include a controller 232, which controls the operation of the game apparatus 10. For example, a wide variety of microprocessors can be used as controller 232, from 8-bit microprocessors to more complex types as is well known to those skilled in the art. Controller 232 can also be coupled to RAM, ROM and/or other components (not shown) that may include start-up instructions, operating system, scratch-pad memory, and other instructions or storage. For example, a start-up procedure including a self-test and a check that the vacuum assembly is in a starting position can be performed as instructed by code stored in ROM. Instructions to perform the game sequence can also be stored in memory. Methods for coupling ROM and RAM to the controller 232 are well-known to those skilled in the art. The controller 232 can also be coupled to I/O circuitry (not shown) which can include such components as drivers, buffers, latches, etc. to interface the components of the control system with the controller.

The controller 232 sequences through the software instructions stored in memory and sends and receives data over control lines in order to conduct a game. For example, when the coin slot switch 234 is activated, indicating a coin has been inserted into coin slot 20, the controller receives a signal the switch and starts a game. The controller 232 receives input signals from other input devices and switches similarly, and outputs signals to control the motors and other output devices. The controller 232 can also implement a timer used to time various stages of game play as discussed in FIG. 9.

Coin operated switch 234 detects when a player has inserted a coin into the game apparatus (or other monetary input). Audio system 236 is controlled by controller 232 to generate audio effects before, during and after game play using a loudspeaker 238, as is well known. Other components coupled to and controlled by an output signal of controller 232 include turntable motor 110, x-motor 148, and z-motor 122. Turntable motor 110 rotates turntable 44 and, in the described embodiment, also moves the conveyor device 40 as described above. In alternate embodiments, a separate motor can be included to drive the conveyor device 40. X-motor 148 moves the vacuum assembly in an x-direction along guide rod 62 as explained above, and z-motor 122 raises and elevates the vacuum head 76 in a z-direction, as explained above. Z-motor 122 also is coupled to a direction switching relay 242 which is used to reverse the direction of the motor by reversing the polarity of the drive voltage. X-motor 148 is similarly coupled to a direction switching relay 244.

Controller 232 controls the supply of power to motors 110, 122, and 148 using power on/off relay or transistor 240. Power is applied directly to the turntable motor 110, which typically only runs in a single direction. The turntable motor 110 may additionally be controlled to stop, start, or slow during game play, as explained below. For z-motor 122 and x-motor 148, the controller 232 uses two lines, one line to control when the motor runs and the other line to control the direction of the motor. The RUN signal provides base current to the power relay 240, and the DIRECTION signal provides base current to a switching transistor in relay 242 to reverse the direction of the motor.

Limit switch 140 is included in the drive system 100 as described with reference to FIG. 3 to stop movement of the vacuum head 76 towards turntable 44 when the vacuum head has reached the lower limit to its movement. The controller 232 can detect the limit switch activation and turn off power to z-motor 122.

A speed control component 246 (potentiometer, etc.) may optionally be coupled to turntable motor 110 to vary the speed of the motor 110. This is used in those embodiments where a player is provided with a control to vary the speed of the rotation of rotary table 44 to allow accurate positioning of the vacuum head 76 over a desired prize object 50 on the turntable. For example, such a control can be slow button 31 which allows the player to slow the speed of the turntable rotation while the button is pressed. Alternatively, slow button 31 can be implemented as a stop button which completely stops the rotation of the turntable 44. In yet other alternate embodiments, a start button can be provided to start the rotation of the turntable.

In alternate embodiments, the x-motor 148 and/or z-motor 122 can provided with player controls (such as a slow button, stop button, and/or start button) and appropriate components similar to the turntable motor 110 to allow the speed of the translation of vacuum assembly 64 to be varied, stopped, or started by the player, thus allowing the player more options to exercise skill in the accurate positioning of the vacuum head 76 over a desired prize object 50 on turntable 44.

Joystick 252 can be included to allow the player to control the x-position of the vacuum assembly 64. A signal indicative of joystick direction can be input to direction switching relay 244 to change direction of the x-motor. For example, the player can move the joystick forward to move the vacuum assembly toward one end of the guide rod 62 (e.g., toward the back of the game apparatus 10), and move the joystick back to move the assembly to the other end of the guide rod (e.g., toward the front of the game apparatus. The allowed joystick directions preferably correspond to directions of movement of the vacuum assembly with reference to the player's position. In other embodiments, the joystick signal can be input to controller 232, which then commands the direction of the motor as appropriate. In alternate embodiments that allow the vacuum assembly to be moved in both x- and y-directions, a four-way joystick can be included to allow the player to control movement in these two degrees of freedom.

Vacuum sensor 190 may be included in some embodiments of game apparatus 10 to detect when a prize object has been picked up, as described with reference to FIG. 7. Sensor 190 sends an appropriate signal to controller 232 when such an event has occurred. Vacuum pump 82 is controlled by controller 232 to cause air to flow through hose 80 and a suction force to be provided at the suction cup end of vacuum head 76.

FIG. 9 is a flow diagram illustrating a method 300 of operating the game apparatus 10 of the present invention. The process begins at 302. Optionally, after the game has been powered up, the controller 232 may checks that the vacuum assembly is in a home position. The home position can be any predetermined position; for example, the home position can be the position nearest vertical support 60 on guide rod 62 with the vacuum head 76 withdrawn to a fully raised position. This step, however, is not necessary in the preferred embodiment.

In step 306, the controller 232 checks whether a coin or other monetary input has been provided to the game apparatus by the player. If not, the process continually checks for a coin at step 306. Once a coin is inserted, the controller 232 enables x-movement of the vacuum assembly 64 as controlled by the player in step 308. Thus, the controller supplies power to x-motor 148 using relay 240 and enables joystick 252 to command a direction of the x-motor with relay 244. In those embodiments implementing y-movement of the vacuum assembly, the y-movement can also be enabled in this step. The controller 232 can also begin the rotation of turntable 44 at this stage in the game process; or, alternatively, the turntable can always be rotating during and between games.

In step 310, the controller 232 checks whether the control time has expired or whether a start button (if included) has been activated. The "control time" is the time allowed for the player to position the vacuum assembly to a desired x-position on guide rod 62. For example, a control time of 9 seconds can be used. If the control time has not expired, the process returns to step 308 to enable further x-movement of the vacuum assembly in step 308. If the control time has expired, then the controller stops the x-motor and disables the joystick in step 312. The controller 232 stops the x-motor by removing current to the motor.

In next step 314, the controller 232 starts the z-motor to lower the vacuum head, and turns on the vacuum pump 82. The z-motor 122 is supplied with power by the controller 232 similarly to the x-motor as explained above. In addition, the vacuum pump 82 is activated by the controller 232 to begin drawing air through vacuum hose 80. Alternatively, the pump 82 can be activated at a later stage of the process, such as just before or at the time the vacuum head contacts a prize or the turntable 44 when it is lowered in step 320, below. For example, a timer can start in step 314, and the vacuum pump can be activated after a predetermined time period expires.

In step 320, the controller 232 stops the z-movement of the vacuum head 76 toward turntable 44 when the vacuum head reaches a lower limit. This lower limit is preferably indicated by limit switch 140 described with reference to FIG. 3. Alternatively, the lower limit can be indicated by a predetermined length of time from the time the vacuum head begins lowering.

During some or all of steps 308–320, the player may, in some embodiments, be allowed to stop or slow the rotation of turntable 44 by activating appropriate buttons or other controls, as explained above. In addition, some embodiments may allow a player to stop or slow x-movement and/or z-movement of the vacuum assembly during game play.

In step 322, the controller detects whether a prize object has been picked up by the vacuum head 76 in those embodiments including a vacuum sensor 190. If a prize object is picked up, the process continues to step 328, described below. If an object has not been picked up, the controller optionally checks whether game time has expired in step 324 "Game time" measures how long a game should last; if this limit is exceeded, the player is out of time and step 328 is implemented. If game time has not expired, then the controller causes the vacuum head 76 to elevate in step 326 and the process returns to step 308 to allow the player to reposition the vacuum assembly and again attempt to pick up a prize. Thus, a player is allowed to keep playing the game until a prize is picked up or game time expires in the vacuum sensor embodiment. In some embodiments, no game time limit need be imposed, so that a player keeps playing until a prize has been picked up and dispensed to the player. Alternatively, the process can return to step 314 after step 326 to allow only z-movement of the vacuum assembly. In addition, in the vacuum sensor embodiments, the controller 232 can monitor the state of the vacuum sensor such that if the collected prize drops prematurely to dispensing, the player might be allowed to continue playing the game.

In embodiments not including a vacuum sensor 190, step 328 can be implemented directly after step 320. For example, the vacuum head 76 can be simply raised in step 328 after a predetermined amount of time expires in which a prize is allowed to be picked up with the suction force caused by pump 82.

In step 328, the controller 232 starts the z-motor 122 to raise the vacuum head 76. A prize object 50 may or may not be attached to the vacuum head. In step 330, the controller controls the x-motor 148 to move the vacuum assembly to a prize-dropping (or "home") position above the conveyor device 40 (in some embodiments, the vacuum head is moved to the home position until a prize is collected by the vacuum head 76). In a preferred embodiment, a timer is started with the start of z-movement of step 328; when a predetermined amount of time expires, the vacuum head is assumed to be in the prize-dropping position, and step 332 is then performed. Alternatively, a sensor might be used to sense when the vacuum head is in the prize-dropping position.

In step 332, the controller 232 deactivates pump 82 to cause a held prize object 50 (if present) to drop onto the conveyor device 40. Conveyor 40 is preferably driven during the game play, or can alternatively be powered when the vacuum head moves to the position to drop the prize. The dropped prize object is immediately moved by the conveyor 40 to the dispenser opening 42 and is thereafter guided to the dispenser 22 on front panel 14 of the game apparatus, where it may be retrieved by the player. In the described embodiment, the home position is at the same x-position on the guide rod at which the prize object is dropped onto conveyor 40; thus, the vacuum assembly is in the correct position for the start of a new game. In alternate embodiments, the controller 232 may move the vacuum assembly 64 to a home position if such a position is different from the prize-dropping position. The process is then complete at 334. Preferably, the process once again begins at step 302, where the game apparatus waits for a coin to be dropped for the next game.

Figure 10:
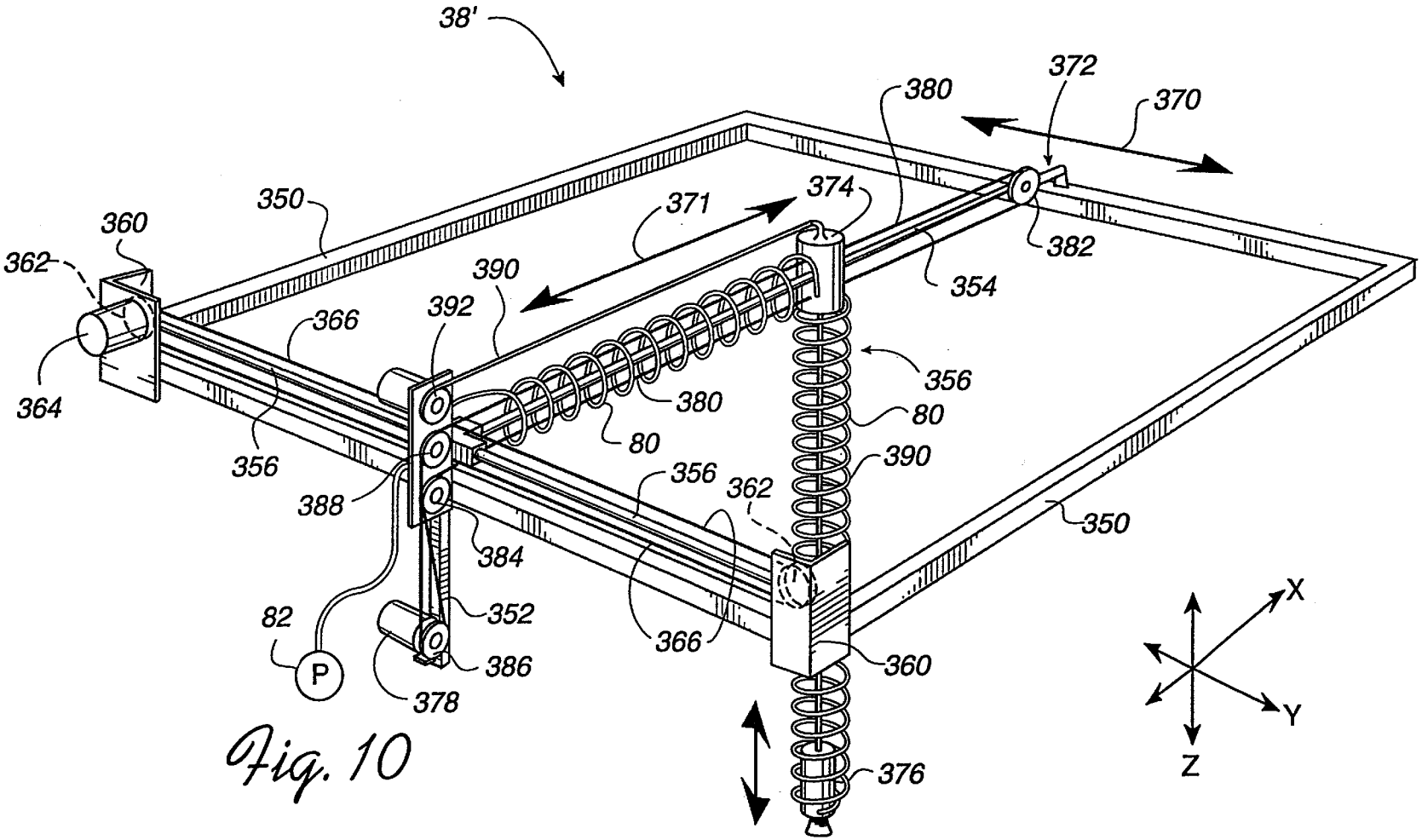
FIG. 10 is a perspective view of another embodiment of a pick up device of the present invention.

FIG. 10 is a perspective view of an example of an alternate embodiment 38' of vacuum pick up device 38 in which the vacuum pick up device 38' may be moved in two degrees of freedom above an area providing prizes. In this embodiment, no rotary turntable need be provided, since the vacuum head 76 can be moved to any point above the prizes. In some embodiments, however, the rotary table can be provided when using vacuum pick up device 38', for example, to provide additional difficulty to players when playing the game. The player may move the vacuum head along x- and y-axes using a joystick or other control, as described above.

Vacuum assembly 38' includes a support frame 350, vertical support 352, x-axis guide rod 354, y-axis guide rod 356, vacuum assembly 358, and pump 82. Support frame 350 may include members coupled to each other in a rectangular configuration for stability, as shown. Frame 350 can be securely coupled to the housing 12 of the game apparatus 10. In the described embodiment, y-axis guide rod 356 is coupled between two support plates 360 and extends parallel to one of the members of the support frame 350. A pulley 362 is rotatably coupled to Y-axis guide rod 356 at each end and to support plates 360. A motor 364 has a rotatable shaft that is rigidly coupled to one of the pulleys 362 and thus drives that pulley.

Vertical support 352 is a floating support that moves along a y-axis along y-axis guide rod 356. A line 366 is coupled to vertical support 352 and is routed around one pulley 360, back through an aperture in vertical support 352, around the other pulley 360, and is coupled to vertical support 352 at the other end of the line. Thus, motor 364 rotates a pulley 360, which causes line 366 to move, causing vertical support 352 to move along y-axis guide rod 356 in a desired direction.

X-axis guide rod 354 is coupled to vertical support 352 and moves along the y-axis in conjunction with vertical support 352, as shown by arrow 370. End 372 of guide rod 354 is supported by frame 350 by a sliding member, wheel, or other component that allows the end 372 to move with respect to frame 350. Guide rod 354 allows the vacuum assembly 356 to move along its length in an x-direction of the x-axis as shown by arrow 371, similarly to the embodiment described above with respect to FIG. 2.

Vacuum assembly 64 includes a carriage 374 and a vacuum head 376, which are similar in function to equivalent components described in FIG. 2. Carriage 374 is moved along x-axis guide rod 354 by a motor 378, which is coupled to vertical support 352. Line 380 is coupled to carriage 374 and is routed parallel to guide rod 354, around an end pulley 382 coupled to guide rod 354, back along the length of guide rod 354, through an aperture in carriage 374, around pulley 384 that is coupled to vertical support 352, around motor pulley 386 coupled to a shaft of motor 378, back around pulley 388 coupled to vertical support 352, and is coupled to carriage 374 at the other end of the line 380. Motor 378 thus rotates pulley 386, which causes line 380 to move carriage 374 along guide rod 354.

Line 390 suspends vacuum head 376 from carriage 374 and operates similarly as described with reference to FIGS. 2 and 5. Line 390 is coupled to vacuum head 376 and is routed through carriage 374. Line 390 is then routed to pulley 392, which can route the line to a take-up roller or function as a take-up roller itself. A motor (not shown) may be used to wind or unwind line 390 to raise or lower vacuum head 376. The vacuum head itself functions as described above. Pump 82 is coupled to the vacuum head 376 by a hose 80 that is coiled around the guide rod 354 and suspended portion of line 390. The pump may be coupled to vertical support 352, carriage 374, grounded areas of the game apparatus, or other locations away from the vacuum head, and performs substantially the same as described above to cause a suction force at vacuum head 376.

A similar x-y movement mechanism to pick up device 38' is described in U.S. Pat. No. 4,718,667, which is incorporated by reference herein.

Since the vacuum head 76 can be positioned directly above the dispenser opening 42 to drop a prize directly into the dispenser, no conveyor device is necessary in embodiment 38'. However, the conveyor device can be provided, if desired, at a point on floor 41 at which the vacuum head can conveniently drop the prize so that the conveyor may move the prize to a dispenser opening or other dispensing device.

While this invention has been described in terms of several embodiments, it is contemplated that alterations, modifications and permutations thereof will become apparent to those skilled in the art upon a reading of the specification and study of the drawings. For example, a large variety of types of prizes can be offered alone or in containers facilitating pick up by the vacuum device. Also, a variety of mechanisms can be used to position the vacuum device over a location on a prize area, to lower the vacuum head toward the prizes, and to dispense the prize to the player.

It is therefore intended that the following claims include all such alterations, modifications and permutations as fall within the spirit and scope of the present invention.

What is claimed is:

1. A game apparatus comprising:

(a) a prize area having a plurality of prizes provided therein;

(b) a pick up device positioned above said prize area, said pick up device including:

(i) a vacuum head operative to pick up one of said prizes using a suction force, said vacuum head including a vacuum sensor operative to sense air flow through said hose and to detect when a prize has been picked up by said vacuum head;

(ii) a positioning mechanism operative to position said vacuum head along an axis above said prize area, wherein said vacuum head is coupled to said positioning mechanism; and (iii) a vacuum pump coupled to said vacuum head by a hose and providing said suction force;

(c) a control device for allowing a player of said game apparatus to position said vacuum head over said prize area at a desired position and pick up said prize using said suction force; and (d) a controller coupled to said control device and said vacuum sensor for controlling operation of said game apparatus.

2. A game apparatus as recited in claim 1 wherein said vacuum head includes a suction cup at one end for assisting in said picking up of one of said prizes.

3. A game apparatus as recited in claim 2 wherein said positioning mechanism moves said vacuum head along a vertical axis toward said prize area.

4. A game apparatus as recited in claim 3 wherein said axis is a z-axis, and wherein said positioning mechanism is further operative to position said vacuum head along a x-axis positioned above said prize area and approximately perpendicular to said z-axis.

5. A game apparatus as recited in claim 4, wherein said controller is a digital controller for controlling operation of said game apparatus.

6. A game apparatus as recited in claim 5 further comprising a limit switch for detecting a predetermined limit of movement of said vacuum head along said z-axis.

7. A game apparatus as recited in claim 6, wherein said digital controller commands motors for driving said pick up device along said z-axis and said x-axis.

8. A game apparatus as recited in claim 4, wherein said positioning mechanism is further operative to position said vacuum head along a y-axis positioned above said prize area and approximately perpendicular to said x-axis and to said y-axis.

9. A game apparatus as recited in claim 3 further comprising a turntable provided in said prize area below said vacuum head and rotatable about a rotation axis, said prizes resting on said turntable.

10. A game apparatus as recited in claim 9 wherein said vacuum head is suspended from said positioning mechanism by a flexible member.

11. A game apparatus as recited in claim 10 wherein said positioning mechanism includes a mechanism coupled to said vacuum head by said flexible member that maintains said vacuum head at a constant position on said vertical axis while said vacuum head is moved in along said horizontal axis.

12. A game apparatus as recited in claim 10 wherein said flexible member is a cord having one end coupled to said vacuum head and a second end coupled to a roller driven by a motor.

13. A game apparatus as recited in claim 9 further comprising a moving device positioned below said pick up device, said moving device operative to receive a prize that has been picked up by said vacuum head and dropped onto said moving device, and wherein said moving device is operative to move said received prize to a dispenser.

14. A game apparatus as recited in claim 13 wherein said moving device is a conveyor device having a conveyor belt.

15. A game apparatus as recited in claim 14 further comprising a button selectable by said player, said button adjusting said rotation of said turntable when selected.

16. A game apparatus as recited in claim 3 wherein said suction cup is made of a flexible material for contacting said prize to be picked up.

17. A vacuum crane game apparatus comprising:

a support frame having a surface;

a plurality of prizes provided on said surface of said support frame;

a vacuum suction device positioned above said plurality of prizes and able to pick up one of said prizes using a suction force;

an x positioning mechanism coupled to said support frame and to said vacuum suction device and operative to position said vacuum suction device at a position in along an x-axis approximately parallel to said surface of said support;

a z positioning mechanism coupled to said vacuum suction device and operative to move said vacuum suction device along a z-axis approximately perpendicular to said surface of said support;

a vacuum sensor coupled to said vacuum suction device for sensing when said vacuum suction device has air flowing therethrough and when said vacuum suction device has picked up one of said prizes.

18. A game apparatus as recited in claim 17 further comprising a vacuum pump for causing said suction force, wherein said vacuum sensor is coupled to a hose that couples said vacuum suction head to said vacuum pump.

19. A game apparatus as recited in claim 18 wherein said vacuum sensor includes a cup and a contact switch, wherein said cup expands when air is flowing through said hose and collapses when air is blocked from flowing through said hose.

20. A game apparatus as recited in claim 18 further comprising a digital controller operative to control said x-positioning device and said z-positioning device, said digital controller monitoring said vacuum sensor to determine when a prize has been picked up by said vacuum suction device.

21. A game apparatus as recited in claim 20 further comprising a conveyor device coupled to said support frame that receives one of said prizes picked up by said vacuum suction device and moves said received prize to a dispenser area.

22. A game apparatus comprising:

vacuum means moveable approximately along only an x-axis and a z-axis and providing a suction force;

rotating means for rotating a plurality of prizes about an axis of rotation approximately perpendicular to a surface of said game apparatus, wherein said vacuum means is operative to move along said z-axis toward said rotating means and pick up one of said prizes using said suction force;

conveyor means for receiving a prize picked up by said vacuum device and dropped on said conveyor means, and for moving said received prize from said dropped position to a dispensing area provided at a perimeter of said rotating means.

23. A game apparatus as recited in claim 22 wherein said conveyor means includes a platform and a moving belt, said belt carrying said dropped prize to said dispensing area.

24. A game apparatus as recited in claim 23 wherein said vacuum means includes a vacuum head coupled to a carriage, said vacuum head moving along said z-axis toward said prizes and said carriage moving along said x-axis, and wherein said rotating means includes a turntable.

25. A game apparatus as recited in claim 24 wherein said vacuum means includes a vacuum pump not positioned on said vacuum head for causing said suction force, said vacuum pump coupled to said vacuum head by a hose, and wherein said vacuum head includes a suction cup for contacting said prizes and to assist in picking up one of said prizes using said suction force.

26. A game apparatus as recited in claim 25 wherein said vacuum means includes a vacuum switch for sensing when air flows through said vacuum head and detecting when a prize has been picked up by said vacuum head.

27. A game apparatus as recited in claim 25 wherein said rotating means includes a rotary turntable on which said plurality of prizes rest.

28. A method for providing a crane game for a player to pick up and receive offered prizes, said method comprising:

rotating a plurality of prizes on a turntable;

using a vacuum pump to cause an air flow to create a suction force from a vacuum head remote from said pump;

moving said vacuum head toward said rotating plurality of prizes;

picking up one of said prizes with said vacuum head, wherein said suction force causes said prize to cling to said vacuum head;

moving said vacuum head to a dispensing area and deactivating said suction force to allow said prize to drop into a dispensing area from which said prize is dispensed to said player; and sensing when said prize has been picked up by said vacuum head.

29. A method as recited in claim 1 wherein said sensing includes sensing an air flow within said vacuum head such that when said air flow is at least partially blocked, said prize has been picked up.

30. A method as recited in claim 29 wherein said air flow is caused by a pump mechanism coupled to said vacuum head by a hose, said pump mechanism located away from said vacuum head.

31. A method as recited in claim 29 further comprising, if said prize has not been picked up, moving said vacuum head away from said prizes along said z-axis.

32. A method as recited in claim 31 further comprising allowing a player to influence said movement of said vacuum head after said prize has not been picked up.

33. A method as recited in claim 28 further comprising receiving a command from said player to adjust said rotation of said prizes.

34. A method as recited in claim 28 further comprising allowing a player to influence said movement of said vacuum head before said prize has been picked up.

35. A method as recited in claim 34 wherein said moving said vacuum head to a dispensing area includes moving said vacuum head and said picked-up prize away from said prizes on said z-axis and moving said vacuum head along an x-axis to a position above said dispensing area.

36. A method as recited in claim 28 wherein said dispensing area includes a conveyor device for receiving said dropped prize and moving said dropped prize to a delivery chute.

37. A method as recited in claim 28 wherein said vacuum head is moved to said dispensing area only if said prize has been sensed to have been picked up.

38. A game apparatus comprising:

(a) a prize area having a plurality of prizes provided therein;

(b) a crane mechanism positioned above said prize area, said crane mechanism including:

(i) a pick up device operative to pick up one of said prizes;

(ii) a horizontal positioning mechanism operative to position said pick up device along a horizontal axis above said prize area, wherein said pick up device is coupled to said horizontal positioning mechanism; and (iii) a vertical positioning mechanism operative to position said pick up device along a vertical axis;

(c) a turntable provided in said prize area below said pick up device and rotatable about a rotation axis, said prizes resting on said turntable and being rotatable about said rotation axis;

(d) a control device allowing a player of said game apparatus to position said pick up device over said turntable at a desired position and pick up one of said prizes; and (e) an actuated moving device positioned below said pick up device, said moving device operative to receive a prize that has been picked up by said pick up device and dropped onto said moving device, and wherein said moving device moves said received prize to a dispenser.

39. A game apparatus as recited in claim 38 wherein said pick up device is a vacuum head, and further comprising a vacuum pump coupled to said vacuum head by a hose and providing a suction force used to grab and hold at least one of said prizes with said vacuum head, said vacuum pump not being positioned on said vacuum head.

40. A game apparatus as recited in claim 38 wherein said dispenser includes an aperture in a surface into which said picked up prize is dropped, wherein said dispenser further includes a guide that routes said dropped prize from said aperture to said player.

41. A game apparatus as recited in claim 40 wherein said moving device is positioned on or adjacent to said prize area.

42. A game apparatus as recited in claim 40 wherein said pick up device can only be moved along said horizontal axis in a plane approximately parallel to said turntable, and wherein said dispenser is provided at a perimeter of said turntable.

43. A game apparatus as recited in claim 38 wherein said moving device includes a conveyor device having a conveyor belt moved by a powered actuator, said belt carrying said dropped prize to said dispenser.

44. A game apparatus as recited in claim 38 such that said pick up device can be positioned above any of said prizes due to said movement of said pick up device along said horizontal axis and due to said rotation of said prizes.

45. A game apparatus as recited in claim 38 further comprising a digital controller for controlling said movement of said moving device and said turntable.

46. A game apparatus comprising:

a rotary table supported by a support frame and rotatable about an axis of rotation;

a plurality of prizes provided on a surface of said rotary table;

a pick up device positioned above said plurality of prizes capable of picking up one of said prizes;

a positioning mechanism coupled to said pick up device and to said support frame and operative to position said pick up device to pick up a desired one of said prizes;

a conveyor device coupled to said support frame that receives one of said prizes released by said pick up device and moves said received prize to a dispenser area.

47. A game apparatus as recited in claim 46 wherein said pick up device is a vacuum pick up device, and further comprising a vacuum pump for causing a suction force from said vacuum pick up device to allow a prize to be picked up.

48. A game apparatus as recited in claim 46 wherein said positioning mechanism includes:

an x positioning mechanism coupled to said support frame and to said pick up device operative to position said pick up device at a position in along an x-axis approximately parallel to said surface of said rotary table; and a z positioning mechanism coupled to said pick up device and operative to move said pick up device along a z-axis approximately perpendicular to said surface of said rotary table.

49. A game apparatus as recited in claim 48 further comprising a digital controller operative to control said x-positioning device, said z-positioning device, said rotary table, and said conveyor device.

50. A game apparatus as recited in claim 46 wherein said dispenser area includes an aperture in a surface into which said picked up prize is released, wherein said aperture is an opening in a guide that routes said released prize from said aperture to said player, and wherein said conveyor device includes a conveyor belt moved by a powered actuator, said belt carrying said released prize to said dispenser area.

* * * * *